US006421832B1

(12) United States Patent
Ondrejko et al.

(10) Patent No.: US 6,421,832 B1
(45) Date of Patent: Jul. 23, 2002

(54) FABRIC DECORATING SYSTEM AND COLORABLE ARTICLE OF WEARING APPAREL

(76) Inventors: Thomas J. Ondrejko; Sara M. Ondrejko, both of 4195 Oak Ridge La., Cambridge, OH (US) 43725-8924

( * ) Notice: Subject to any disclaimer, the term of this patent is extended or adjusted under 35 U.S.C. 154(b) by 0 days.

(21) Appl. No.: 09/627,263

(22) Filed: Jul. 28, 2000

Related U.S. Application Data

(60) Provisional application No. 60/146,188, filed on Jul. 29, 1999.

(51) Int. Cl.[7] ..... A41D 27/06; A41B 1/00

(52) U.S. Cl. ..... 2/69; 2/115

(58) Field of Search ..... 2/69, 113, 120, 2/121, 122, 115, 244, 209.12, 209.13, 258, 260.1

(56) References Cited

U.S. PATENT DOCUMENTS 4,627,110 A 12/1986 Tengs ..... 2/69

*Primary Examiner*—Gloria M. Hale
*Assistant Examiner*—Alissa L. Hoey
(74) *Attorney, Agent, or Firm*—Standley & Gilcrest LLP

(57) ABSTRACT

A system and method for allowing easy coloring or writing on the surface of a fabric item. The present invention involves the installation of a reinforcing material, such as a fusible interfacing, to the underside of an outer surface of a fabric item to be marked upon, such that a stable coloring or writing surface is produced. The coloring or writing may be done with washable markers or crayons, such that the markings may be repeatedly washed out and the fabric item re-colored or re-written upon. Borders, images, scenes or other graphics may also be placed on the outer surface of the fabric item to help indicate the reinforced area and/or to add to the appearance of the coloring or writing. The fabric item may be an article of wearing apparel or virtually any other item constructed of suitable material.

20 Claims, 3 Drawing Sheets

FABRIC DECORATING SYSTEM AND COLORABLE ARTICLE OF WEARING APPAREL

CROSS REFERENCE TO RELATED APPLICATIONS

This application hereby claims benefit under 35 U.S.C. 1.19(e) of U.S. provisional application Serial No. 60/146,188, filed Jul. 29, 1999, entitled "Article of Wearing Apparel with Reinforced Coloring/Writing Surface".

BACKGROUND AND SUMMARY OF THE INVENTION

Parents, day care teachers, school art teachers, camp counselors, babysitters, etc., all face the challenge of finding engrossing, worthwhile projects for kids. It is well known that children love to color. The idea of coloring/writing on T-shirts or other apparel arose from these observations, and, as such, the present invention involves the use of apparel or other fabric items, such as tote bags, as a basis for creating wearable, reusable art.

There are currently kits in existence which utilize T-shirts or other items bearing outlined designs which one can paint. Painting is, of course, permanent. Computers make it possible for artwork to be scanned and printed as a heat transfer, which may then be applied to a T-shirt or other item using an iron or heat transfer press. This process is also permanent. Older youth frequently like to wear clothing that makes a statement, whether it is to support a sports team, to espouse a word or quote, or to express feelings. One can have such a T-shirt custom made at a T-shirt shop with lettering and/or pictures. Again, however, this is a permanent process.

A method also exists for producing an article of wearing apparel with an erasable writing surface, as disclosed by U.S. Pat. No. 4,627,110 to Tengs. However, this method involves the cost, possible physical discomfort, and aesthetics of adding a special writing surface to the outside of the garment. Also, this method emphasizes writing, rather than coloring, and there is some doubt as to the success of this method when used for coloring. Finally, this method involves a message that may be erased or removed by lifting it off the garment, in contrast to a removal by washing method as contemplated by the present invention.

There are many instances in which it would be preferable to have a T-shirt or other item which may be colored or written upon, wherein, rather than being erasable or removable, the coloring or writing would remain until the item is washed. For example, a child at a day care facility might need to take medicine during his or her stay. If he or she was wearing a special T-shirt or other apparel bearing the necessary information, it would aid the staff in remembering to administer the medication. Preferably, the T-shirt or other apparel would be washable and thus reusable. One would not want it to be permanent, for practical and economic reasons, nor erasable, for safety reasons.

Many children's books have inspired sideline products, such as stuffed animals, which one can purchase along with the books. Similarly, another possibility would be to preprint, or even utilize stencils, to create outlines of book scenes on T-shirts or other items that children may then color. Because a garment or other such item is generally much more expensive than paper or other typical coloring receivers, a garment or other such item that may be repeatedly colored, washed and re-colored is highly desirable.

A major problem with coloring or writing on a garment or similar item, such as a T-shirt, is that the garment material does not typically provide sufficient rigidity to allow easy application of the coloring or writing. Generally, when using a marker or crayon on such material, the material will tend either to stretch or fold up, causing a less than desirable writing surface. Although the application of a separate writing surface to the outside of the garment in U.S. Pat. No. 4,627,110 may somewhat alleviate this difficulty, none of the prior art mentioned has overcome the problem while allowing the coloring or writing to be performed directly on the garment material itself.

The present invention overcomes this problem by adding a reinforcing material, such as a fusible interfacing, to the underside of the garment in the area of desired coloring or writing. The addition of the fusible interfacing provides enough support to enable coloring and/or writing directly on the garment material, without being so stiff as to make the garment uncomfortable when worn. The colored garment or other item can be worn or used and then washed to allow for re-coloring and/or re-writing. Washable markers allow continued reuse for writing new messages or performing new coloring, while indelible markers allow the application of a permanent message, picture or picture outline.

Garments or other items can also be embellished with permanent outlines of messages or scenes, using transfers, screen printing, or stencils, for example. These outlines or scenes may then be colored in or written upon. If reuse is desired (including the stenciling process itself), coloring or writing may be done repeatedly with washable markers and the old work removed upon washing. Otherwise, permanent markers may be used.

An incidental benefit of applying the fusible interfacing is that it may serve to inhibit the cracking or separation common to heat transfer and other graphics caused by the stretching of the material to which they are applied. Thus, the application of fusible interfacing to the underside of a garment may be of benefit even if markings are applied thereto by a method other than coloring.

BRIEF DESCRIPTION OF THE DRAWINGS

The invention and its attendant objects and advantages will become better understood upon reading the following description of the preferred embodiments in connection with the following drawings, wherein like reference numerals across the several views refer to like features or parts, and wherein.

DETAILED DESCRIPTION OF THE EMBODIMENT(S)

T-shirts are popular apparel for children, and thus are particularly amenable to the process of the present invention. Although the process of the present invention may be applied to a wide variety of fabric items, for purposes of illustration, and not limitation, the process will only be described below as applied to a T-shirt. Additionally, although the present invention will likely be especially attractive to children, nothing in this specification should be interpreted to mean that the invention is not applicable to practice by persons of all ages.

Figure 1:
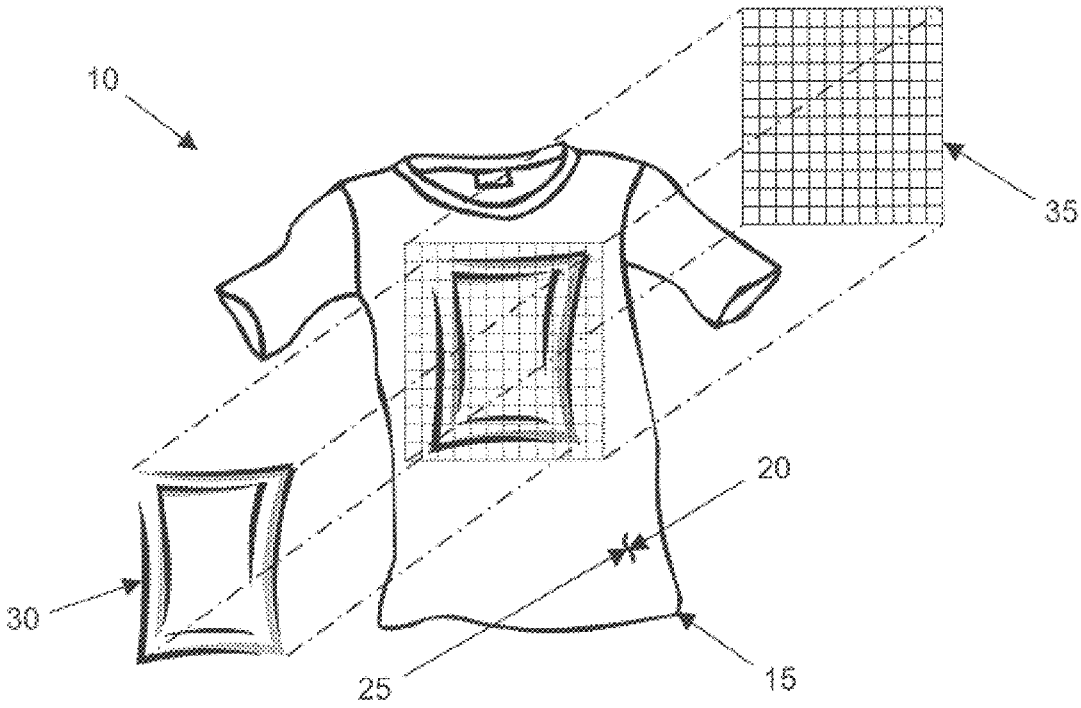
FIG. 1 is a perspective view of an embodiment of a fabric decorating system of the present invention as applied to a T-shirt, illustrating the attachment of a fusible interfacing and a graphic to opposite surfaces of the fabric on one side thereof.

FIG. 1 depicts one embodiment of a fabric decorating system 10 of the present invention, wherein at least one layer of fusible interfacing 35 is applied to the underside 20 of an outer surface 25 of a T-shirt 15 to provide a more stable area for coloring or writing. The Pellon® line of lighweight, white fusible interfacing available from Freudenberg Non-Wovens Limited has provided good results when used for this purpose. Although the T-shirt 15 of this embodiment is preferably constructed of a 50% cotton/50% polyester blend, other fabrics may also be employed.

Like the T-shirt material itself, fusible interfacing 35 tends to stretch more in one direction than the other. Thus, if only a single layer of fusible interfacing 35 is used, it is preferred that the direction of greater stretch in the interfacing be oriented at an angle to the direction of greater stretch in the T-shirt 15. Although other angles may be acceptable, preferably, the angle should be approximately 90 degrees.

Additional stability may be imparted to the T-shirt 15 by using multiple layers of fusible interfacing 35. Preferably, each additional layer of fusible interfacing 35 should be oriented such that the direction of greater stretch in each layer is at an angle to the previous layer. Although a variety of angles are acceptable, an angle of approximately 90 degrees is preferred. In one preferred embodiment of the invention, two or three layers of fusible interfacing 35 may be used.

The fusible interfacing 35 is preferably placed against an underside 20 of the T-shirt 15 material, in the area upon which the coloring or writing will take place. Even if multiple layers of fusible interfacing 35 are utilized, preferably at least one layer of the fusible interfacing should have its direction of greater stretch at an angle to the direction of greater stretch in the T-shirt 15. The fusible interfacing 35 is preferably affixed to the underside 20 of the T-shirt 15 material by applying heat and pressure, such as with an iron, or more preferably, with a heat transfer press. Although application parameters may vary, good results have been obtained by employing a heat transfer press at a temperature of approximately 300 degrees fahrenheit, to press the T-shirt 15 and fusible interfacing 35 for between about 8 to 10 seconds at a pressure of approximately 15 PSI.

Referring still to FIG. 1, a heat transfer graphic 30 is shown being applied to an outer surface 25 of the T-shirt 15. Although a heat transfer graphic 30 is not essential to the present invention, such a graphic may be desirable to delineate the coloring/writing area of the T-shirt 15.

If a heat transfer graphic 30 is utilized, it may be applied at the same time as the fusible interfacing 35. In such a case, the heat transfer graphic 30 and the fusible interfacing 35 are preferably aligned on the T-shirt 15 prior to the application of heat by an iron or heat transfer press. Because the ideal heat, pressure, and time settings for applying a heat transfer graphic 30 may be different than the respective settings for applying fusible interfacing 35, wrinkles in the T-shirt 15 may result after washing if both are applied simultaneously. The possibility of wrinkles may be minimized by placing the heat platen of the heat transfer press against the heat transfer graphic 30, with the fusible interfacing 35 isolated by the heat transfer graphic and the material of the T-shirt 15. The best results may be rendered by utilizing settings more favorable to a heat transfer graphic 30, thus possibly exceeding the ideal settings for the fusible interfacing 35. A typical heat transfer press set-up for simultaneously applying a heat transfer graphic 30 and fusible interfacing 35 may include a temperature setting of between approximately 350 to 390 degrees Fahrenheit, with application at a pressure of between about 50 to 55 pounds per square inch for roughly 10 to 15 seconds.

Figure 2:
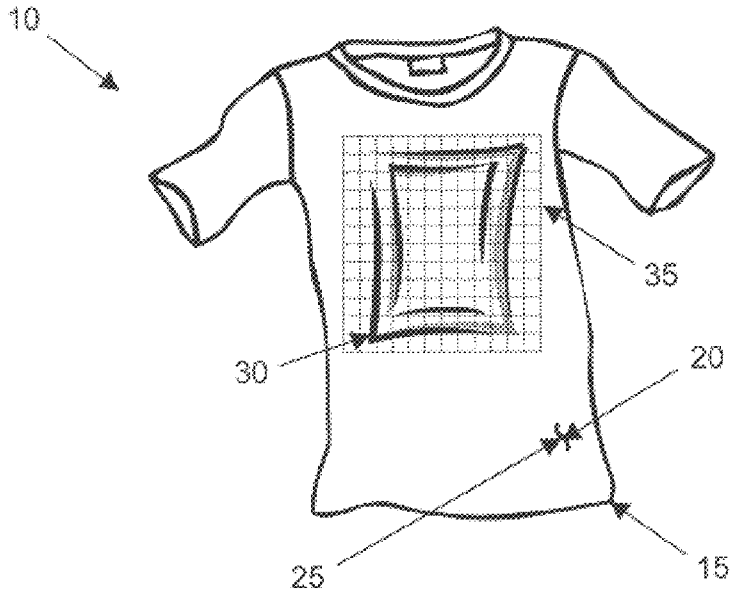
FIG. 2 is a front view of the T-shirt of FIG. 1, showing the attached placement and alignment of the graphic and fusible interfacing wherein the interfacing is shown as visible through the fabric of said T-shirt for purposes of clarity only.

Referring now to FIG. 2, the T-shirt 15 of FIG. 1 may be seen with the heat transfer graphic 30 and the fusible interfacing 35 affixed thereto. As illustrated, it is preferable that the fusible interfacing 35 extend at least to, and more preferably beyond the edges of the coloring or writing area defined by the heat transfer graphic 30. Although the fusible interfacing 35 is actually on the underside 20 of the outer surface 25 of the T-shirt 15 material, it is depicted as visible in FIG. 2 for purposes of clarity. When viewing the T-shirt 15, after application of the heat transfer graphic 30 and fusible interfacing 35 according to the present invention, only the heat transfer graphic is actually visible on the outer surface.

Figure 3:
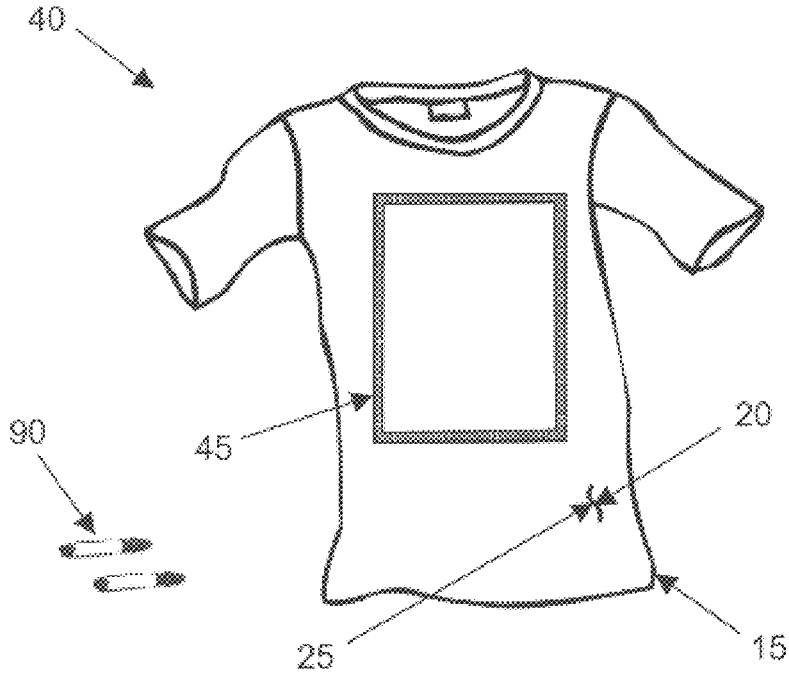
FIG. 3 shows a front view of another embodiment of the present invention, wherein said T-shirt has a graphic border on its outer surface indicating the boundaries of the coloring/writing area as defined by the fusible interfacing (not shown)

FIGS. 3–6 illustrate alternate embodiments of the present invention, wherein other designs may be placed on the outer surface 25 of the T-shirt 15 that is to be colored or written upon. FIG. 3 illustrates another embodiment of a fabric decorating system 40 of the present invention, again applied to the T-shirt 15 of FIGS. 1 and 2. A graphic 45, such as the empty picture frame shown, may be affixed to the outer surface 25 of the T-shirt 15. The graphic 45 is illustrated as a heat transfer in this particular embodiment, but may also be a screen-printed image, for example. The graphic 45 is preferably applied to line up with the fusible interfacing (not shown) located on the underside 20 of the outer surface 25 of the T-shirt 15, so as to create a stable surface within the graphic upon which the user may color or write.

Figure 4:
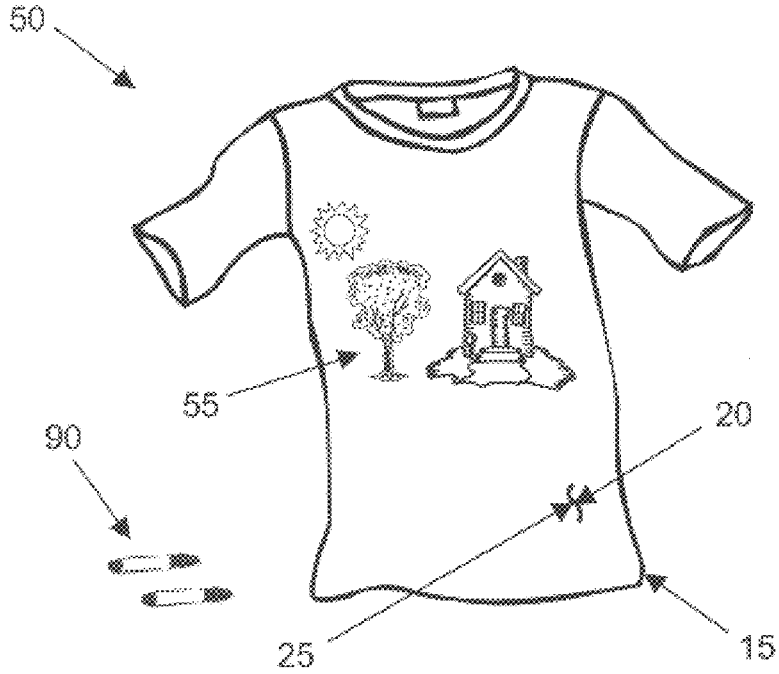
FIG. 4 illustrates a front view of an alternate embodiment of the present invention, wherein said T-shirt has an image placed on its outer surface over the area of the fusible interfacing (not shown), such that said fusible interfacing provides adequate support for the coloring of the image.
Figure 5:
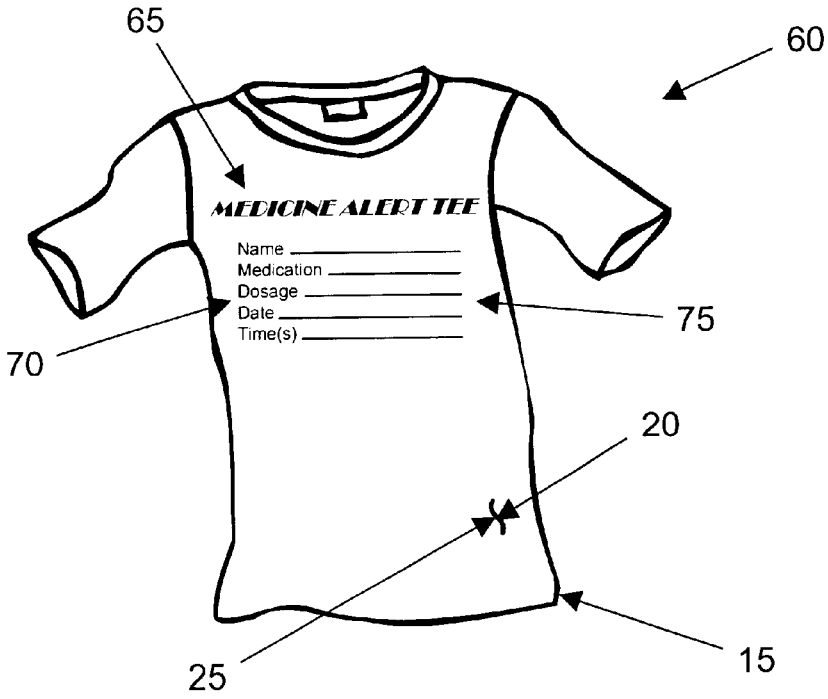
FIG. 5 is a front view of another embodiment of the present invention, wherein said T-shirt contains a message area instead of a border or image, and wherein the fusible interfacing (not shown) resides upon the underside of said T-shirt in the message area for supporting the writing of additional information in the blank spaces provided.

A fabric decorating system 50 of the present invention may also include an image or scene 55 on the outer surface 25 of the T-shirt 15, as depicted in the alternate embodiment of FIG. 4. While the scene 55 in this particular embodiment is contemplated as a heat transfer, a screen-printed image may also be applied, or the user may apply an image or scene using a stencil and either an indelible or a washable marker depending upon whether or not the user wants a permanent outline. Again, the scene 55 is preferably applied to line up with the fusible interfacing (not shown) on the underside 20 of the outer surface 25 of the T-shirt 15, so as to create a stable marking area.

In addition to providing entertainment, the fabric decorating system of the present invention may also convey useful information. Such an example may be seen in the embodiment of FIG. 5, wherein the fabric decorating system 60 has been used to provide the outer surface 25 of the T-shirt 15 with a message area 70 containing permanent wording 65 combined with blank spaces 75 for writing temporary information. A heat transfer graphic or other means, such as screen-printing or stenciling, for example, could be used to provide the permanent wording 65. Fusible interfacing (not shown) affixed to the underside 20 of the outer surface 25 of the T-shirt 15, and behind the message area 70, provides sufficient structural stability to allow for easy writing. For this particular embodiment, a reusable T-shirt 15 is economically ideal. At the same time, however, one would not want the message to be erasable. A washably removable message, created using washable markers or crayons, provides the perfect solution. Such a garment could be ideal for a child attending a day care center, for example.

Figure 6:
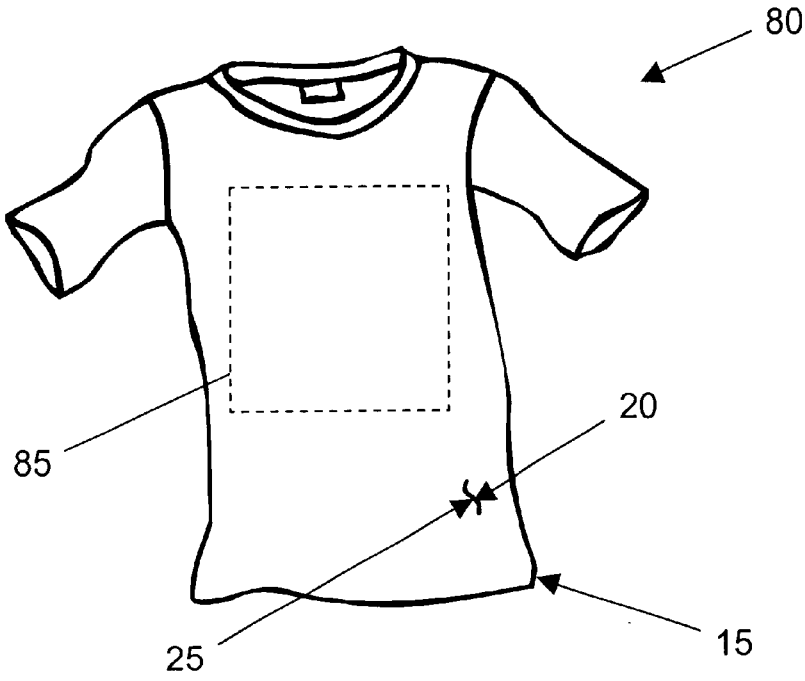
FIG. 6 is a front view representing an additional embodiment of the present invention, wherein the boundaries of the coloring or writing area on the T-shirt are not graphically indicated, and the user is free to draw or write as seen fit.

Still another embodiment of a fabric decorating system 80 of the present invention may be seen by reference to FIG. 6. Although in this embodiment, no border or other means is used to indicate the boundaries of the drawing or writing area, the boundaries 85 of the fusible interfacing will generally be intelligible when the T-shirt 15 is laid out on a table or other flat surface. The fusible interfacing (not shown) is once again affixed to the underside 20 of the outer surface 25 of the T-shirt 15, in order to provide the necessary support for coloring or writing thereon. This embodiment contemplates allowing the user to freely mark the T-shirt 15 in the area of the fusible interfacing with any design or writing that he or she wishes.

It should be realized that, while the fusible interfacing 35 is shown and described as affixed to the underside 20 of the outer surface 25 of the front of a T-shirt 15 in FIGS. 1–6, the fusible interfacing may be of various size and could be affixed to the underside of any portion of the T-shirt upon which coloring and/or writing is desired.

It is preferable to use existing marking devices for coloring and/or writing on the items to which the fabric decorating system of the present invention is applied. Although not entirely unusable, generally neither regular nor washable crayons satisfactorily wash out of typical T-shirt material. Also, crayons are typically relatively hard and tend to push the fabric around excessively during use. Experimentation has shown that washable markers 90 (FIGS. 3 and 4) should preferably be used to provide the most satisfactory marking. While the manufacturers of common washable markers may not have intended for such markers to be intentionally applied to textiles and then washed out completely, the markers may be used in this way successfully. Good results may be obtained by employing washable markers such as, for example, the Crayola® Supertips® line available from Binney & Smith in Easton, Pa., or those available from Pentech International in Edison, N.J.

With the exception of certain pink and purple pigments, the colors have generally shown themselves to wash out well in hot water. When stains remain, a second washing will usually adequately remove them. Any stains still remaining after a second washing may generally be removed by further soaking in bleach according to the bleach directions, despite the marker manufacturer's warnings to the contrary. The manufacturers also warn against using pre-wash solutions, and as expected, the use of these solutions has not provided improved results.

The above disclosure is not intended to limit the scope of the invention to the use of fusible interfacing. Other methods of reinforcing the T-shirt material could be employed, such as applying a transfer, plastic sheet, or filler resins to the underside of the T-shirt. However, while such other materials may function to allow the desired writing and/or coloring, they are generally less desirable for use as interfacing because they do not provide the proper amount of rigidity, are not reusable, are not "breathable", hinder washability, or have a higher cost. Despite this, it is to be understood that these and other methods and materials of supporting the underside 20 of a T-shirt 15 or other fabric are within the spirit and scope of the present invention. Additionally, modifications to minimize inadvertent "washing" of any writing or coloring, such as spraying Scotch-Gard® or similar products over such writing and/or coloring, are understood to be covered by the present invention. Thus, while certain embodiments of the present invention are described in detail above, the scope of the invention is not to be considered limited by such disclosure, and modifications are possible without departing from the spirit of the invention as evidenced by the following claims.

What is claimed is:

1. A fabric decorating system, comprising:

a fabric item;

multiple layers of a fusible interfacing affixed to an inner surface of said fabric item, at least one layer of said fusible interfacing located so that a direction of greater stretch in said interfacing is oriented at an angle to a direction of greater stretch in said fabric item, with each succeeding layer of said fusible interfacing located so that said direction of greater stretch in said interfacing is oriented at an angle to said direction of greater stretch in the preceding layer of said interfacing; and an area for marking located on an outer surface of said fabric item;

wherein said area for marking is positioned to be substantially aligned with the location of the underlying fusible interfacing, such that a stable area is formed upon which said fabric item may be marked.

2. The fabric decorating system of claim 1, wherein said reinforcing material is affixed to said fabric item by the application of heat and pressure.

3. The fabric decorating system of claim 1, wherein said marking may be removed from said fabric item by washing.

4. The fabric decorating system of claim 1, further comprising a graphic located on said outer surface of said fabric item to indicate said area for marking.

5. The fabric decorating system of claim 4, wherein said graphic is a heat transfer.

6. The fabric decorating system of claim 4, wherein said graphic is screen-printed.

7. An article of wearing apparel, comprising:

a fabric garment;

multiple layers of a fusible interfacing affixed to an inner surface of said fabric garment, at least one layer of said fusible interfacing located so that a direction of greater stretch in said interfacing is oriented at an angle to a direction of greater stretch in said fabric garment, with each succeeding layer of said fusible interfacing located so that said direction of greater stretch in said interfacing is oriented at an angle to said direction of greater stretch in the preceding layer of said interfacing; and an area for marking located on an outer surface of said fabric garment;

wherein said area for marking is positioned to be substantially aligned with the location of the underlying fusible interfacing, such that a stable area is formed upon which said fabric garment may be marked.

8. The article of wearing apparel of claim 7, wherein said reinforcing material is affixed to said fabric garment by the application of heat and pressure.

9. The article of wearing apparel of claim 7, wherein said marking may be removed from said fabric garment by washing.

10. The article of wearing apparel of claim 7, further comprising a graphic located on said outer surface of said fabric garment to indicate said area for marking.

11. The article of wearing apparel of claim 10, wherein said graphic is a heat transfer.

12. The article of wearing apparel of claim 10, wherein said graphic is screen-printed.

13. A method for producing a markable garment, comprising:

providing a garment to be marked; and affixing multiple layers of fusible interfacing to an inner surface of said garment substantially in an area upon which marking is to take place, at least one layer of said fusible interfacing located so that a direction of greater stretch in said interfacing is oriented at an angle to a direction of greater stretch in said garment, with each succeeding layer of said fusible interfacing located so that said direction of greater stretch in said interfacing is oriented at an angle to said direction of greater stretch in the preceding layer of said interfacing;

whereby said fusible interfacing improves the stability of said garment, thereby providing a smooth surface on which to mark.

14. The method of claim 13, wherein said reinforcing material is affixed to said fabric item by the application of heat and pressure.

15. The method of claim 13, further comprising applying a graphic to said outer surface of said fabric item to indicate an area for marking.

16. The method of claim 15, wherein said graphic is a heat transfer.

17. The method of claim 16, further comprising the simultaneous application of said reinforcing material and said heat transfer graphic.

18. The method of claim 15, wherein said graphic is screen-printed.

19. The method of claim 13, wherein said marking is done with washable markers.

20. The method of claim 19, wherein said marking may be removed from said fabric item by washing.

* * * * *